United States Patent [19]

Massman

[11] 3,953,956

[45] May 4, 1976

[54] APPARATUS FOR FORMING FLAPS ON A CARTON

[75] Inventor: Burl Massman, Villard, Minn.

[73] Assignee: Hayssen Manufacturing Company, Sheboygan, Wis.

[22] Filed: Nov. 29, 1974

[21] Appl. No.: 528,231

[52] U.S. Cl. ..... 53/124 B; 53/208; 53/374; 83/193; 93/58 R

[51] Int. Cl.[2] ..... B31B 1/14

[58] Field of Search ..... 93/58 R, 58 ST, 58.3, 93/36 R; 53/208, 285, 372, 374, 381, 124 B; 83/185, 188, 191, 193, 178

[56] References Cited

UNITED STATES PATENTS

| | | | |
|---|---|---|---|
| 3,015,197 | 1/1962 | Eichorn | 53/208 |
| 3,545,167 | 12/1970 | Lawler | 53/183 X |
| 3,606,724 | 9/1971 | Otto | 53/38 X |

*Primary Examiner*—James F. Coan

*Attorney, Agent, or Firm*—Koenig, Senniger, Powers and Leavitt

[57] ABSTRACT

Apparatus for forming flaps at the top of an open-top carton after it has been packed, with the flap formation correlated to the level of the top of the contents of the carton, having means for internally scoring the walls of the carton generally at said level, means for slitting the corners of the carton generally down to said level, and means for trimming off the tops of the side walls of the carton so that they may be folded on top of the carton without overlap. In forming the flaps, the apparatus is adapted to compress the contents of the carton. The scoring means includes a set of scoring blades which fit in a carton on top of the contents and a set of external presser members for pressing the carton walls against the blade edges. The scoring blades are replaceable with blades of different sizes and provision is made for adjustment of the presser members and trimming means to operate on cartons of different sizes.

23 Claims, 17 Drawing Figures

APPARATUS FOR FORMING FLAPS ON A CARTON

BACKGROUND OF THE INVENTION

This invention relates to apparatus for forming flaps on a carton after the carton has been packed, with the flaps correlated to the level of the top of the contents of the carton, and more particularly to such apparatus for scoring the walls of the carton at said level, slitting the corners of the carton down to said level, and trimming off the tops of the side walls of the carton.

The invention is especially concerned with apparatus for forming flaps on cartons packed with wrapped reams of paper (e.g., reams of 8½ × 11 inches sheets of paper), although it is to be understood that apparatus made in accordance with the invention may be used for forming flaps on cartons packed with other commodities.

In general, reams of paper are presently packaged either in cartons which are pre-scored and pre-slit to have pre-formed top flaps or in cartons with separate lids. As to either of these systems, a relatively large number of different height cartons must be stocked. As to packaging reams in cartons with pre-formed top flaps, the height of the stack or stacks of reams in the carton may vary considerably, and this requires insertion of sheets of cardboard or corrugated board ("fillerboards") to fill whatever space there may be between the top of the reams and the folded-down flaps. This is wasteful of material (the fillerboards) and labor. As to use of separate lids, the lids may be pre-formed or folded in place on the cartons. In either case, material is wasted due to the necessary overlap of the sides of the lid and the carton, extensible strapping should be used, adding to the cost, and there are other disadvantages. Additional problems ensue from the present method of forming the sheets and stacking the sheets in reams (this method being referred to as "slitting and sheeting") due to this method resulting in entrapment of air between the sheets in the ream. This necessitates use of a carton of a height sufficient to accommodate the reams with the entrapped air. As the cartons lie in storage stacked one on top of another in a warehouse, the air eventually escapes, reducing the height of the reams in the cartons, thereby removing the support afforded the top of a carton by the reams, with resultant bulging and rupture of cartons.

The invention is in the same general class as U.S. Pat. No. 3,015,197, issued Jan. 2, 1962, which shows apparatus for slitting the corners of a carton down to the level of the top of its contents, and to fold the resultant flaps outwardly on fold lines at said level.

SUMMARY OF THE INVENTION

Among the several objects of the invention may be noted that the provision of improved apparatus for forming flaps at the top of an open-top carton with the flaps correlated to the level of the top of the contents (e.g., reams of paper) of the carton; the provision of such apparatus adapted to score the walls of the carton on the inside of the carton generally at said level, as distinguished from folding the upper portions of the walls outwardly; the provision of such apparatus adapted to slit the corners of the carton generally down to said inside scores; the provision of such apparatus adapted to trim off the top of the side walls of the carton in accordance with said level so that the side flaps of the carton do not overlap when folded down on top of the carton; the provision of such apparatus adapted to compress the contents of the carton thereby to expel air from the contents and reduce the volume of the contents (and hence lower the level of the top of the contents); and the provision of such apparatus adapted for operation on cartons of different sizes.

In general, apparatus of this invention comprises means for internally scoring the walls of a carton after it has been packed generally at the level of the top of the contents of the carton. The scoring means comprises a set of scoring blades, one for each wall of the carton, and means mounting these blades to fit in the carton with each blade extending generally horizontally along the inside of a respective wall of the carton and with the blades lying flat on top of the contents of the carton and in a plane generally at the level of the top of the contents, each blade having an outer edge constituting a scoring edge, and a set of presser members, one for each blade, surrounding the blades. Means is provided for effecting relative movement of the presser members and blades for scoring the walls of a carton disposed between the blades and the presser members by compressing the walls between said scoring edges of the blades and the presser members. Further, means is provided for effecting relative movement of the carton and the scoring means to position the blades inside the carton on top of the contents of the carton with the blades lying flat on top of the contents in said plane and with the walls of the carton between the blades and the presser members, the latter and the blades then being relatively movable for compression of the walls between said scoring edges of the blades and the presser members to score the walls on the inside thereof generally at said level.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 2:
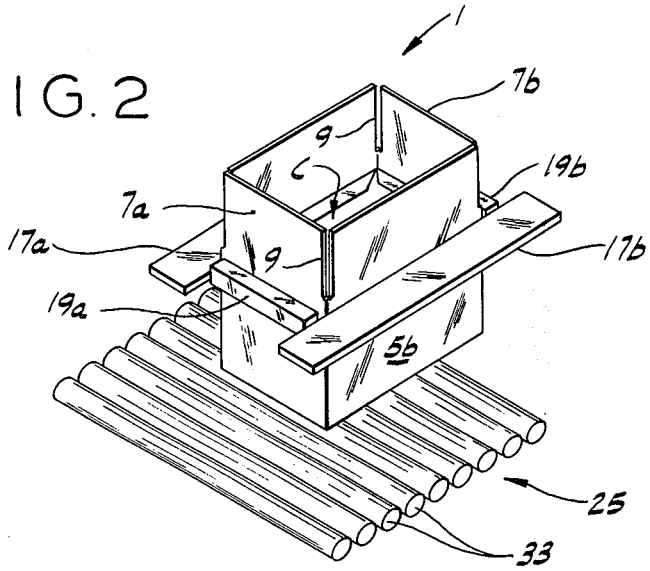
FIG. 2 is a perspective generally illustrating a scoring step in the operation.

Referring to the drawings, first more particularly to FIGS. 1–5, there is indicated at 1 an open-top carton of a type which is to have closure flaps formed at its top by means of apparatus of this invention, with the flaps correlated to the level of the top of the contents of the carton. As shown, the carton is of rectangular form in plan, having a bottom 3, side walls 5*a* and 5*b*, and end walls 7*a* and 7*b*, being open at the top. The four corners of the carton may be partially slit down from the top as indicated at 9; the length of these slits, however, is generally considerably less than the final length of slit needed for forming the top closure flaps. The carton may be formed of corrugated boxboard, for example. It is packed before being sent through the flap-forming apparatus of this invention, the contents of the carton being indicated at C. The contents may comprise a number of reams of paper, for example, or any of a wide variety of products including such items as floor or ceiling tile. As a specific example, the carton may hold two stacks of five reams each of 8½ × 11 inches paper for use in copying machines (500 sheets per ream), the carton being about 17⅛ inches long, 11⅛ inches wide and 16 inches high.

Figure 1:
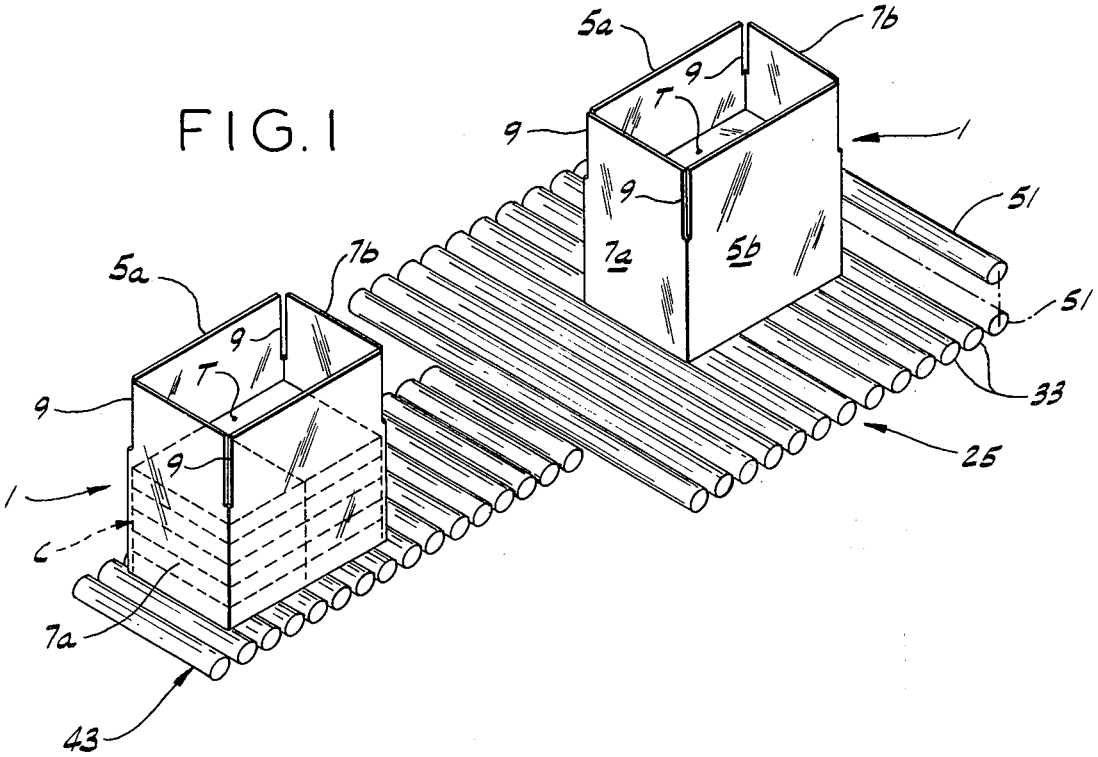
FIG. 1 is a perspective generally illustrating an initial step in the operation of apparatus of this invention for forming flaps at the top of an open-top carton with the flaps correlated to the level of the top of the contents of the carton.

In many instances, including packing of paper in a carton, the contents may have a substantial volume of air therein and hence occupy a larger volume than necessary, making it desirable that the contents be compressed to expel the air and reduce the volume to a minimum. With regard to paper, for example, the individual sheets may be stacked in such manner that there is an appreciable amount of air between the sheets, the volume of the paper is initially placed in the carton thereby being greater than necessary. FIG. 1 shows two five-ream stacks of paper packed in the carton 1, with the top of the contents, as initially placed in the carton, designated T.

Now referring to FIGS. 3, 4 and 7–11, apparatus of this invention for forming flaps at the top of the open-top carton 1 with the flaps correlated to the level of the top T of the contents C of the carton is shown to comprise means indicated in its entirety at 11 for internally scoring the side walls 5 and end walls 7 of the carton generally at the level of the top of the contents. This scoring means comprises a set of scoring blades, one for each wall of the carton, means mounting the blades to fit in the carton with each blade extending generally horizontally along the inside of a respective wall of the carton, and a set of presser members, one for each blade, surrounding the blades. The scoring blades for the side walls of the carton are designated 13*a* and 13*b* and the scoring blades for the end walls are designated 15*a* and 15*b*. The presser members for the side walls are designated 17*a* and 17*b* and the presser members for the end walls are designated 19*a* and 19*b*. Means such as will be described is provided for effecting relative movement of the presser members and blades (and more particularly movement of the presser members relative to the blades) for scoring the walls of a carton disposed between the blades and the presser members by compressing the walls between the outer edges 24 of the blades and the presser members. Edges 24 may be referred to as scoring edges. Means indicated in its entirety at 25 is provided for effecting relative movement of the carton 1 and the scoring means 11 to position the scoring blades inside the carton on top of the contents C of the carton with the blades lying flat on top of the contents of the carton and in a plane generally at the level of the top of the contents, with the blades projecting laterally outwardly beyond the contents and with the walls of the carton between the blades and the presser members, the presser members and the blades then being relatively movable (the presser members moving inwardly relative to the blades) for compression of the walls between the blade edges 24 and the presser members to score the walls on the inside thereof generally at the level of the top of the contents C. Means 27 is provided for slitting each of the four corners of the carton down to said level, and means 29 is provided for trimming off the top of the two opposite side walls 5 of the carton in accordance with said level. In some cartons, it is desirable that the flaps be trimmed so that they may be folded on top of the carton without overlap, and in other cartons it is desirable that these flaps be trimmed so that they overlap for making a dust-tight seal.

Figure 7:
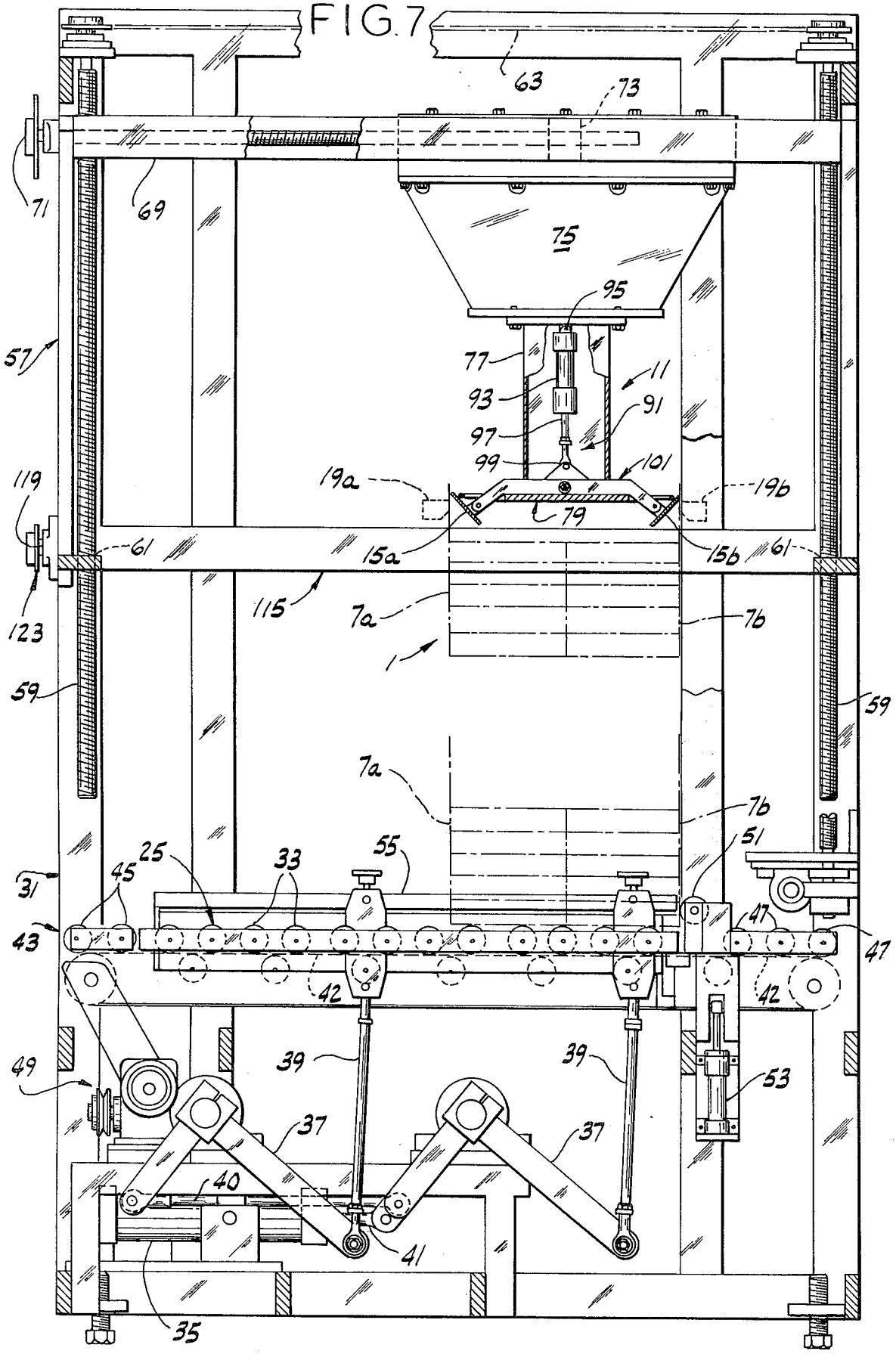
FIG. 7 is a side elevation of the apparatus.

The scoring means 11 is operative at a predetermined elevation in a main frame 31, and the means 25 for effecting the relative movement of the carton and the scoring means comprises an elevator guided for vertical movement in the frame for raising a carton up to the scoring means and lowering the carton, after forming the flaps, down from the scoring means, the carton being raised to a position determined by engagement of the top T of its contents C with the scoring blades. The elevator comprises a roller platform including generally horizontal rollers 33 extending transversely with respect to the frame for rolling a packed carton onto the platform from one end and rolling it off the other end of the platform. The roller platform is vertically movable in the frame by means of a pair of fluid power cylinders (air cylinders) 35 acting via a pair of bell cranks 37 and connecting rods 39. The bell cranks are connected together by a link 40. The arrangement is such that, with the piston rods 41 of the cylinders retracted, the roller platform 25 occupies a lowered retracted position toward the bottom of the frame as illustrated in FIG. 7. On extension of the piston rods 41, the roller platform is raised to raise a carton thereon. When the roller platform is down in its lowered retracted position, the rollers 33 engage a pair of driving belts 42 for driving the rollers to move a carton on the rollers forward, which is toward the right as viewed in FIG. 7. A carton is adapted to be fed onto the roller platform (when it is down) via an infeed roller conveyor such as indicated at 43 in FIGS. 1 and 7 including a set of rollers 45 in the frame (two such rollers 45 being shown), and fed off the roller platform via an outfeed roller conveyor including a set of rollers 47 in the frame (three such rollers being shown). In its lowered retracted position (shown in FIG. 7), the platform 25 bridges the space between the infeed and outfeed rollers 45 and 47, and lies at the same level as the latter. The drive belts 42 engage rollers 45 and 47 for driving them. Means for driving the belts is indicated at 49.

A carton 1 fed from the left as viewed in FIGS. 1 and 7 onto the roller platform 25 by the infeed conveyor 43 is conveyed forward on the roller platform by the rollers 33 being driven by the belts 42 until it engages a stop 51. The latter is constituted by a roller movable up and down at the forward end of the roller platform 25 by means of an air cylinder 53 between a raised position above the platform and a lowered retracted position below the top of the platform. When in its raised position, roller 51 arrests a carton traveling forward on the platform 25 in the proper longitudinal position to be raised for being scored by the scoring means 11. The carton is centered laterally with respect to the scoring means 11 by means of side guides 55 adjustably carried by the platform 25. Roller 51 is moved down to its lowered position to enable a carton to be fed off the roller platform.

Figure 3:
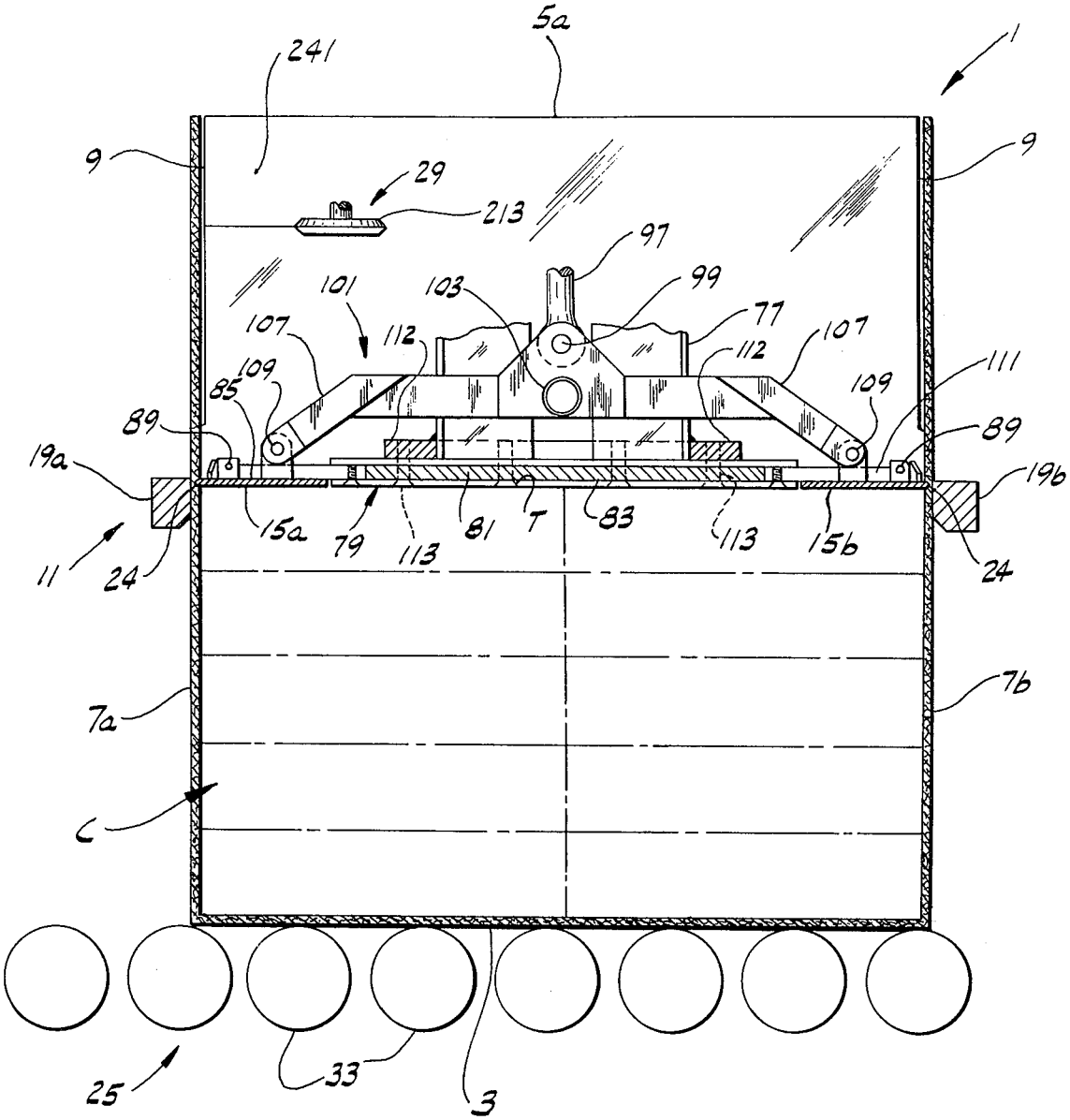
FIGS. 3 and 4 are enlarged vertical sections detailing the scoring step of FIG. 2, and also illustrating a trimming step.
Figure 4:
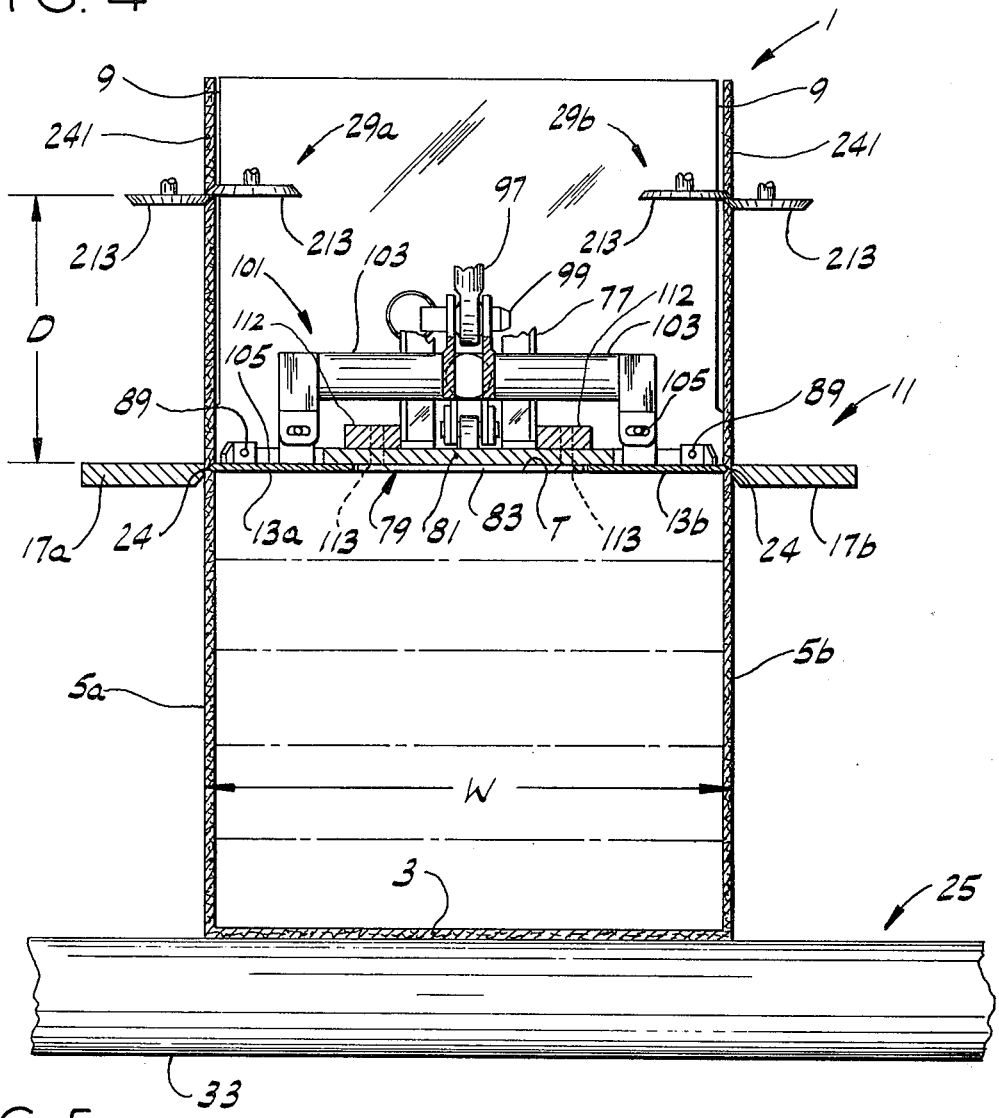
Figure 8:
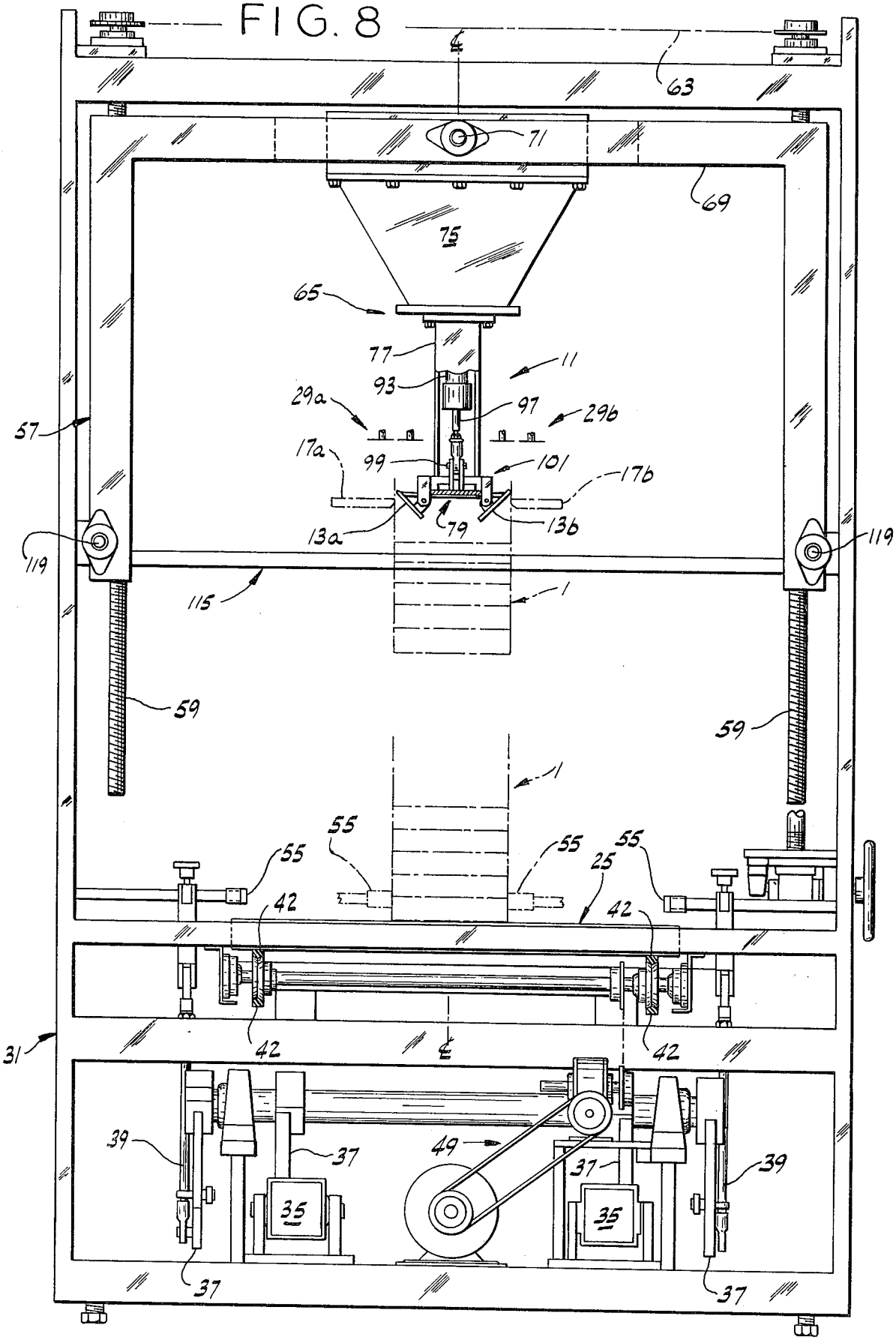
FIG. 8 is an end elevation of the apparatus (as viewed from the left of FIG. 6)
Figure 9:
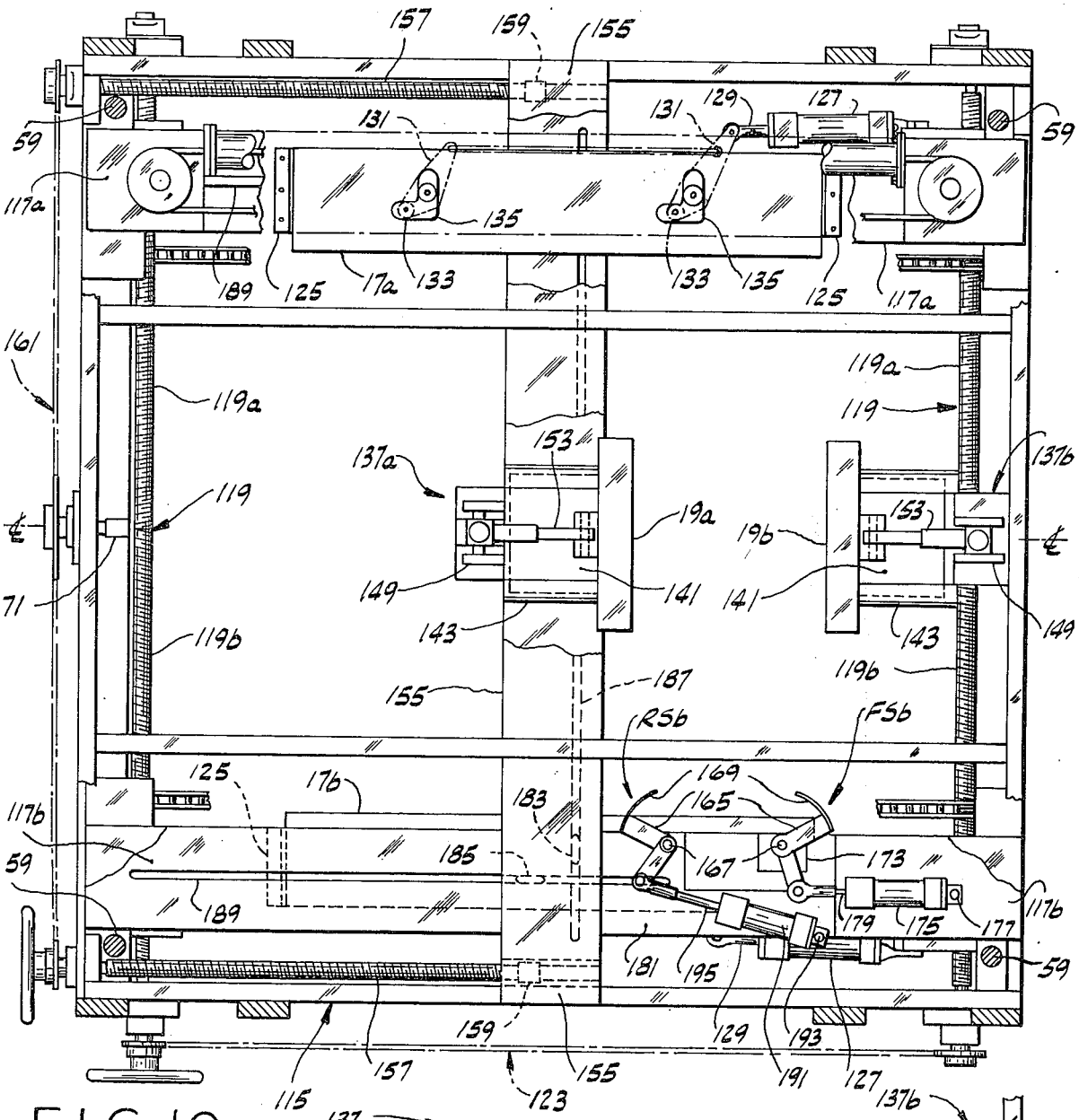
FIG. 9 is a plan of the apparatus with parts omitted.
Figure 10:
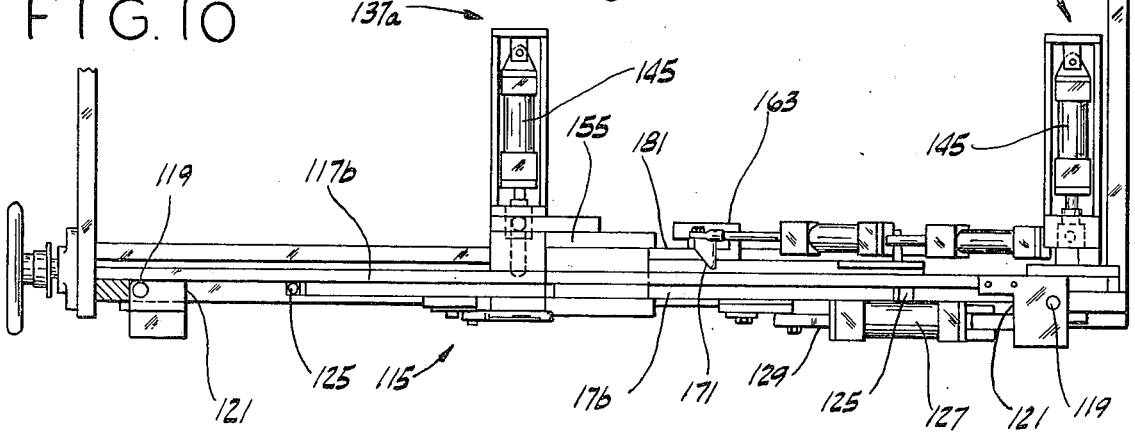
FIG. 10 is a side elevation of FIG. 9.

A subframe 57 is mounted for vertical adjustment in the main frame 31 above the elevator 25. The vertical adjustment of this subframe is effected by means of vertical screws 59 at the corners of the main frame threaded in nuts such as indicated at 61 in FIG. 7 on the subframe. The screws may be driven in unison via a chain and sprocket drive such as indicated at 63 to adjust the subframe up and down for accommodating cartons of various heights and for accommodating various levels of the contents in the cartons. The scoring blades 13*a*, *b* and 15*a*, *b* are mounted at the bottom compression head designated in its entirety by the reference numeral 65. This head 65 extends down from an upper stage 69 of the subframe 57, being carried by this upper stage 69 of the subframe for adjustment longitudinally of the apparatus. The longitudinal adjustment of the head 65 is effected by means of a screw 71 extending longitudinally of the upper stage of the subframe threaded in a nut 73 on the head. The head comprises an upper carriage structure 75 slidable longitudinally of the upper stage 69 and a rectangular housing 77 extending down from the carriage structure 75 with a removable platen 79 at the lower end of the housing 77. The platen 79 comprises an upper relatively thick rectangular plate 81 and a lower relatively thin rectangular plate 83. The latter is smaller than the upper plate 81 to provide a rabbet 85 around all four sides of the platen at its bottom. The scoring blades 13*a*, *b* for the side walls of a carton are hinged as indicated at 89 on the side edges of the upper plate 81 and the scoring blades 15*a*, *b* for the end walls of a carton are pivoted in the same manner on the end edges of the upper plate 81 for rocking of the blades between the retracted position in which they are shown in FIGS. 7 and 8 for their entry in a carton, and the generally horizontal scoring position in which they are shown in FIGS. 3 and 4. In their retracted position (which may also be referred to as their entry position), the scoring blades are inclined upwardly and outwardly at the edges of the plate 81, and in their scoring position they are coplanar with the lower plate 83, lying in the rabbet 85, with their outer margins projecting outwardly beyond the edges of the upper plate 81 (see FIGS. 3 and 4).

At 91 is generally indicated means for rocking the scoring blades between their entry and scoring positions. As shown, this means comprises an air cylinder 93 housed in the housing 77, and pinned at its upper end as indicated as 95 at the upper end of the housing 77. The piston rod 97 of the cylinder extends out of the lower end of the cylinder and has a removable pin connection at 99 with a cruciform yoke structure indicated generally at 101 comprising arms 103 having pin and slot connections 105 with the side blades 13*a* and 13*b*, and arms 107 having pin and slot connections 109 with the end blades 15*a* and 15*b*. The housing is slotted as indicated at 110 for passage of the arms, and the upper plate 81 has slots 111 for the arms. The platen 79 is removably attached to flanges 112 at the lower end of the housing as by means of screws 113. The platen 79, blades 13*a*, *b* and 15*a*, *b* and yoke 101 constitute an assembly which may be removed from the lower end of housing 77 by removing the screws 113 and disconnecting the yoke from the piston rod at 99 for replacement with other assemblies having platens and blades of different sizes for scoring cartons of different sizes.

The presser members 17*a*, 17*b*, 19*a* and 19*b*, the carton corner slitting means 27 and the carton side wall trimming means 29 are all carried by a lower stage 115 of the vertically adjustable subframe 57. This lower stage is in the form of an open rectangular frame. The side wall presser members 17*a* and 17*b* are adjustable transversely of the lower stage 115 and the end wall presser member 19*a* is adjustable longitudinally of the lower stage 115 for operation on cartons of different sizes. For this purpose, left-and right-hand carriages 117*a* and 117*b* are carried by the lower stage 115 for adjustment toward and away from one another transversely of the lower stage. Left and right hand are as viewed in the direction of travel of the cartons through the apparatus. Adjustment of the carriages is effected by means of horizontal screws 119 extending transversely of the lower stage 115 at its rearward and forward ends threaded in nuts 121 on the carriages. These screws may be driven in unison via a chain and sprocket drive 123 to adjust the carriages in and out relative to the vertical longitudinal central plane of the apparatus, which is indicated at CL in FIGS. 8 and 9. Each of the screws has oppositely threaded sections 119*a* and 119*b* for the two carriages so that on rotation of the screws in one direction, the carriages move in, and on rotation of the screws in the opposite direction, the carriages move out.

Each of the side wall presser member 17*a* and 17*b* is constituted by a relatively long and narrow plate mounted for sliding movement underneath the respective carriage 117*a* or 117*b* in and out relative to the carriage by means of guides 125 (see FIG. 9 particularly) on the bottom of the carriage at the ends of the plate. Each of the plates 17*a* and 17*b* is movable in and out relative to its carriage by means of an air cylinder 127 having its piston rod 129 connected to levers 131 carrying rollers 133 riding in slots 135 in the plate. The arrangement is such that on extension of the piston rod 129 from the cylinder 127, the presser member is advanced (moved inward relative to the respective carriage 117*a* or 117*b*) and on retraction of the piston rod, the presser member is retracted. Each of the presser members 17*a* and 17*b* is long enough to handle any size of carton within the range of the apparatus.

Figure 16:
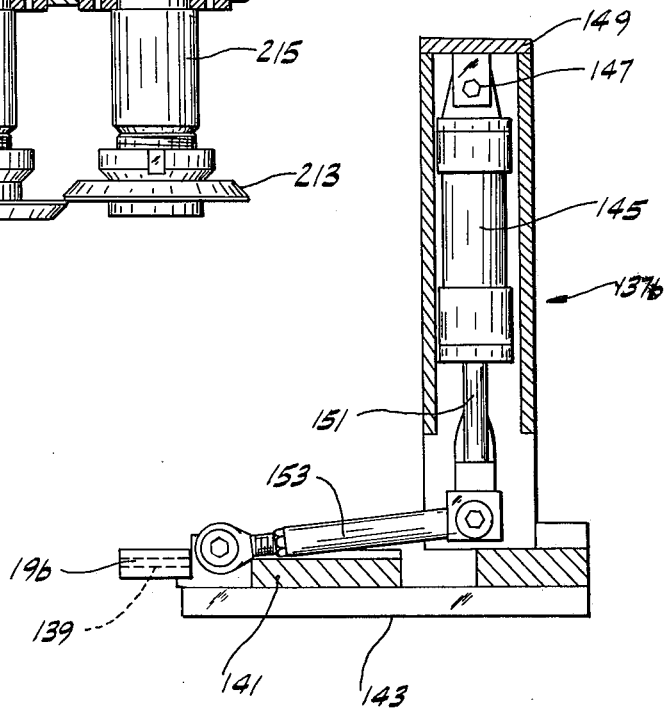
FIG. 16 is a detail of an end wall presser.

The end wall presser member 19*a* is part of an end wall presser assembly designated in its entirety by the reference character 137*a* and the end wall presser member 19*b* is part of a similar assembly designated in its entirety by the reference character 137*b*. Each of the members 19*a* and 19*b* is constituted by a bar having a length slightly less than the width of a carton to be handled. In each of assemblies 137*a* and 137*b*, the presser bar is removably attached as by means of screws 139 to a slider 141 guided for sliding movement on a base 143 of channel shape in cross section. The bar is advanced and retracted by means of an air cylinder 145 pinned at its upper end as indicated at 147 to a column 149 extending up from the base, the cylinder having its piston rod 151 extending from its lower end and connected by a link 153 to the slider. The arrangement is such that on extension of the piston rod from the cylinder, the slider and presser bar are advanced for effecting scoring, and on retraction of the piston rod, the bar is returned to the retracted position in which it appears on FIG. 16.

Base 143 of assembly 137*b* including the end wall presser member 19*b* is mounted on lower stage 115 of the subframe 57 in fixed position relative to the latter in the vertical longitudinal center plane CL of the apparatus with the member 19*b* movable rearward (inward) from its retracted position on extension of the respective piston rod 151. Base 143 of assembly 137*a* including end wall presser member 19*a* is mounted in the plane CL on a carriage 155 carried by the lower stage 115 for adjustment of assembly 137*a* toward and away from assembly 137*b*. Adjustment of carriage 155 is effected by means of screws 157 extending longitudinally at the sides of the lower stage 115 threaded in nuts 159 on the carriage. The screws are connected for being driven in unison by a chain and sprocket drive 161. The arrangement is such that on turning screws 157 in one direction, carriage 155 is moved forward and on turning the screws in the opposite direction carriage 155 is moved rearward. The presser members or bars 19*a* and 19*b* shown are removable and replaceable with presser members or bars of different length for handling cartons of different width.

The corner slitting means 27 comprises a rearward slitter RS*a* and a forward slitter FS*a* on the left side carriage 117*a* for slitting the rearward and forward left hand corners of a carton, and a rearward slitter RS*b* and a forward slitter FS*b* on the right side carriage 117*b* for slitting the rearward and forward right hand corners of a carton. Each of the rearward corner slitters RS*a* and RS*b* comprises a base 163 having a bell crank 165 pivoted thereon as indicated at 167 for swinging movement on a vertical axis. Extending horizontally from one end of the bell crank is a curved arm 169 having a tapered knife 171 extending down from its free end. Each of the forward corner slitters FS*a* and FS*b* is similar to the rearward corner slitter, but has a somewhat different base designated 173.

Each of the forward corner slitters FS*a* and FS*b* has its base 173 mounted on the respective carriage 117*a* or 117*b* with its knife 171 in position for slitting the respective corner of a carton when the carton has been raised by the elevator 25 as will appear. Thus, the forward corner slitters FS*a* and FS*b* are movable in and out with the carriages 117*a* and 117*b* according to the width of cartons being handled. As to each forward corner slitter, an air cylinder 175 has one end pinned at 177 on the respective carriage 117*a*, 117*b* with its piston rod 179 extending from its other end and connected to the respective bell crank 165. The arrangement is such that on extension of the piston rod 179, the knife 171 is swung outwardly away from the retracted position in which it appears in FIG. 9, and on retraction of the piston rod the knife is returned to its retracted position.

Each rear corner slitter RS*a* and RS*b* has its base 163 mounted on an adjustment plate 181 which lies between the respective carriage 117*a* or 117*b* and the carriage 155. This adjustment plate 181 is movable forward and rearward with the carriage 155 and in and out with the respective carriage 117*a* or 117*b* via tongues 183 and 185 on the plate sliding in grooves 187 and 189 in the respective carriages 117*a* or 117*b* and the carriage 155. As to each rear corner slitter RS*a* and RS*b*, an air cylinder 191 has one end pinned at 193 on the plate 181, with its piston rod 195 extending from its other end and connected to the bell crank 165 of the slitter. The arrangement is such that on retraction of the piston rod 195, the rear corner slitter knife 171 is swung outwardly away from its retracted position of FIG. 9 and on extension of the piston rod 195 the knife is returned to its retracted position.

Figure 11:
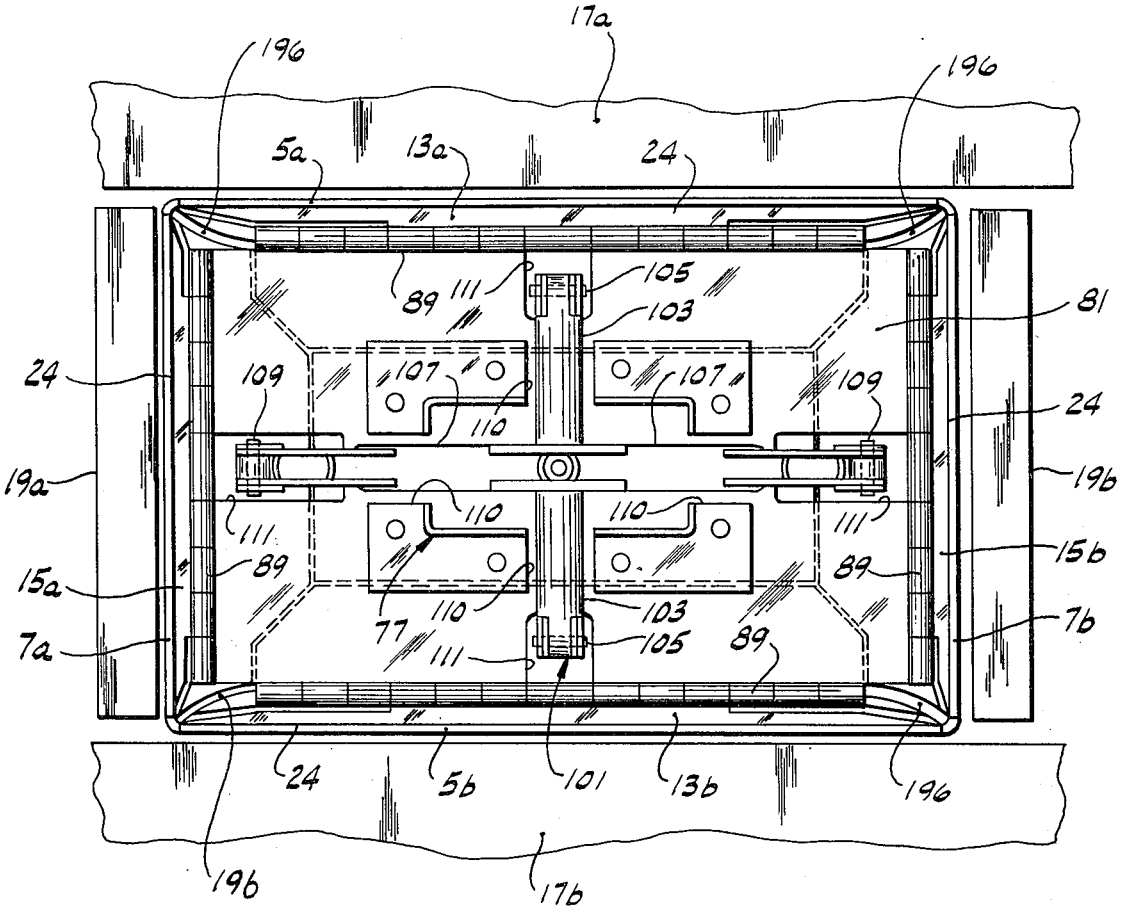
FIG. 11 is a plan of FIG. 3 showing certain presser members retracted.
Figure 14:
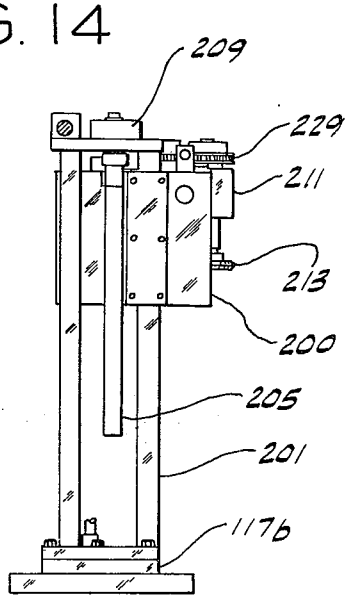
FIG. 14 is an end elevation of FIG. 12.
Figure 12:
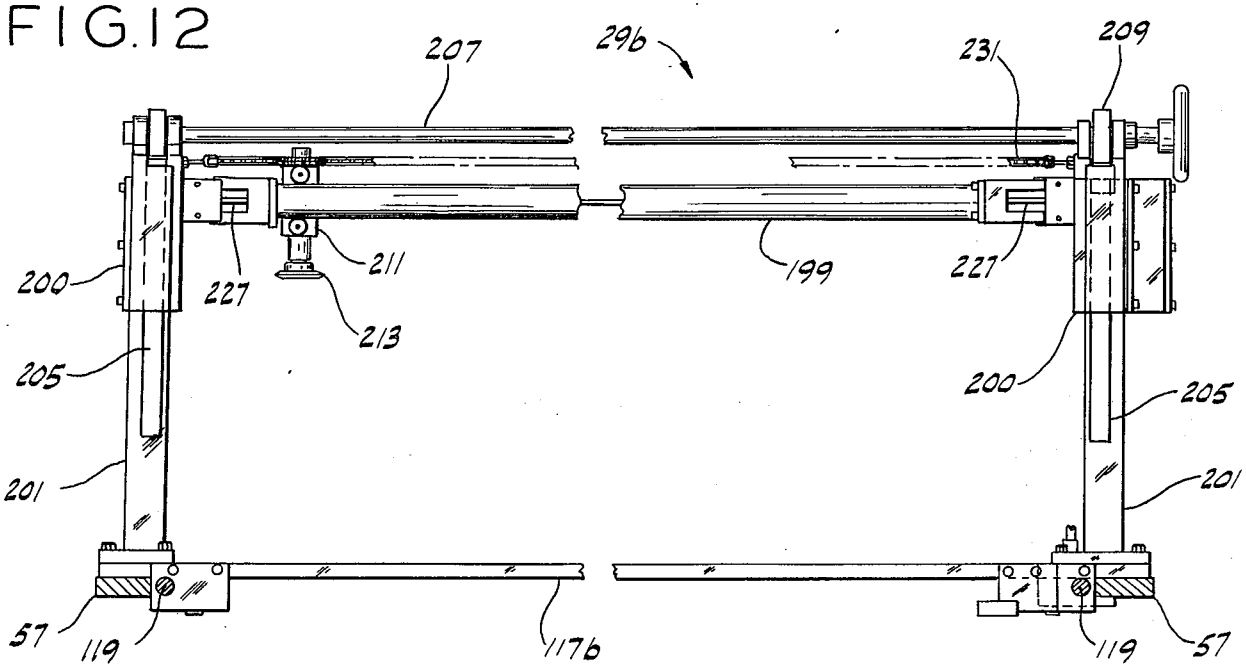
FIG. 12 is a side elevation of a trimming means.
Figure 13:
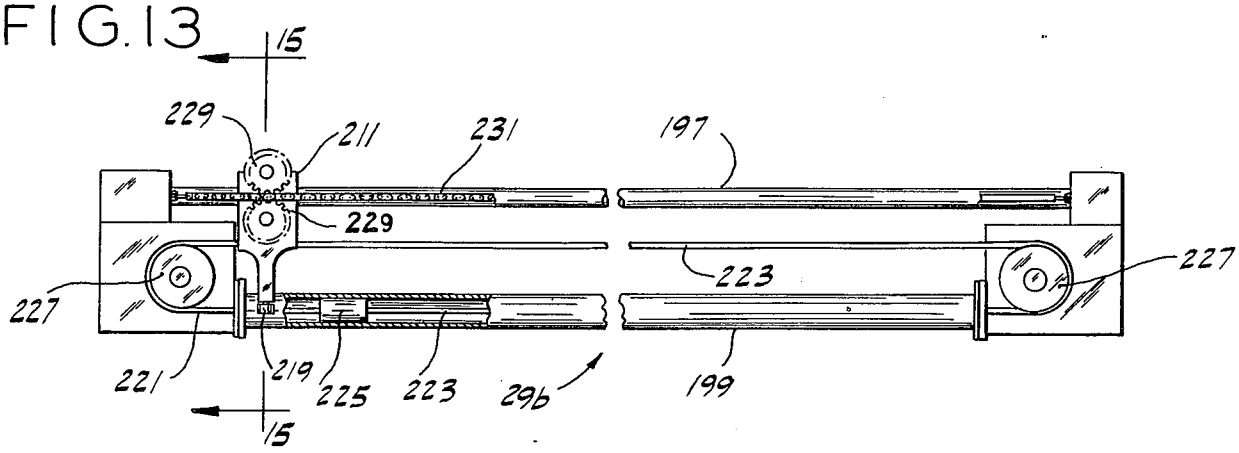
FIG. 13 is a plan of FIG. 12.
Figure 15:
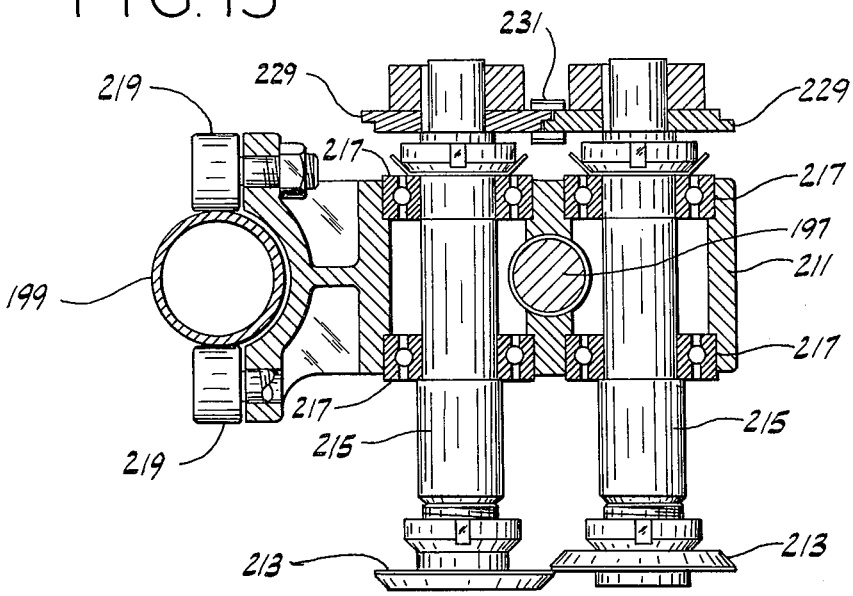
FIG. 15 is a section on line 15—15 of FIG. 13.
Figure 17:
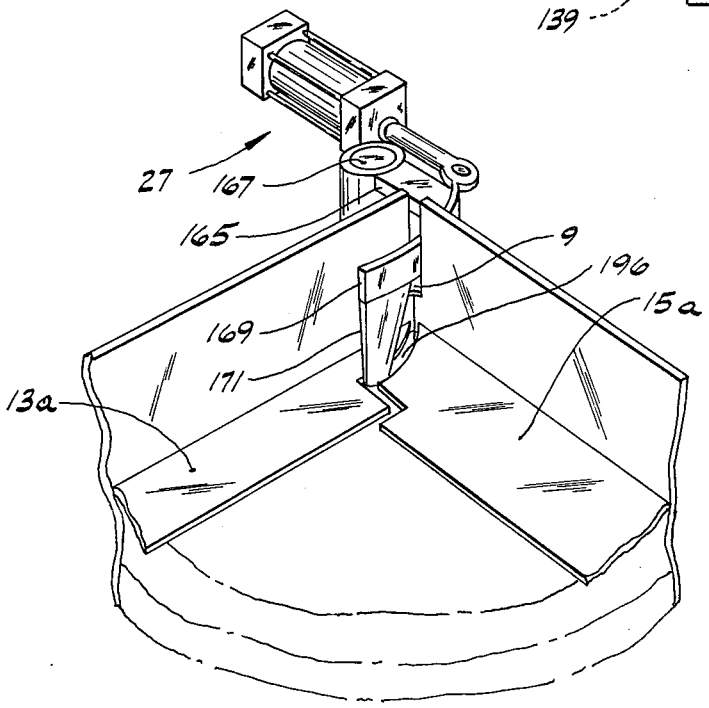
FIG. 17 is a perspective illustrating a corner slitter.

In FIGS. 11 and 17, the ends of scoring blades 13*a*, *b* and 15*a*, *b* are so structured that, when the blades are in their horizontal scoring position, curved slots 196 are provided adjacent the ends of the blades for reception of the lower end of a respective slitting blade 167 as these blades are swung to slit the carton. Slots 196 permit blades 171 to slit the carton as close as possible to the level of scores formed on the carton flap by scoring blades 13*a*, *b* and 15*a*, *b*.

The trimming means 29 comprises a left-side wall trimmer 29*a* on the left-side carriage 117*a* and a right-side wall trimmer 29*b* on the right-side wall carriage 117*b*. Each of these trimmers comprises a guide rod 197 and a long slender air cylinder 199 extending side-by-side parallel to one another between sliders 200 slidable up and down on standards 201 extending up from the ends of the respective left- or right-side carriage 117*a* or 117*b*. The rod and cylinder extend longitudinally with respect to the carriage. The sliders are vertically adjustable on the standards via the adjustment screws 205 operable in unison by a manually operable shaft 207 and gearing 209. A carriage 211 is slidable longitudinally with respect to the carriage 117*a* (or 117*b*) on the guide rod 197, and carries slitting means comprising a pair of slitter disks 213 secured on the lower ends of a pair of vertical shafts 215 journalled in bearings 217 in the carriage 211 and extending down from the carriage 211. The carriage has outboard rollers 219 which roll on the air cylinder 199 to keep the carriage from rotating on the rod 197. Cables 221 and 223 extend from a piston 225 in the cylinder through the ends of the cylinder and around pulleys 227 carried by the sliders 200 to connections with the carriage for sliding the carriage along the rod 197 from adjacent one end of the carriage 117*a* (or 117*b*) to the other. Each of the shafts 215 has a sprocket 229 on its upper end in mesh with a fixed length of chain 231 extending above the rod 197 for rotating the slitter disks 213 in one direction or the other as the disks move with the carriage 211 in one direction or the other along the rod 197.

As noted above, a carton 1, after having been packed (e.g., with ten reams of paper in two stacks of five each) is fed forward by the infeed conveyor 43 (FIGS. 1 and 7) onto the roller platform 25 and thence fed forward by rollers 33 of the roller platform until it is arrested in proper longitudinal position relative to the scoring means 11 by the stop roller 51. The latter is so located relative to the forward end wall presser member 19*b* as to stop the carton in position with the forward end wall 7*b* of the carton somewhat rearward of the vertical plane of the rear face of member 19*b* (see FIG. 7). Side guides 55 center the carton laterally relative to member 19*b* and relative to the scoring means 11 (see FIG. 8).

Depending on the length, width and height of cartons 1 of a run to be sent through the apparatus, the following set-up will have been made prior to the run:

1. A platen 79 with scoring blades 13*a*, 13*b*, 15*a* and 15*b* of the size corresponding to the length and width of the inside dimensions of the carton will have been mounted at the lower end of the compression head housing 77.

2. End wall presser members 19*a* and 19*b* of a length slightly less than the width of the carton will have been mounted on the respective slider 141.

3. The subframe 57 will have been adjusted vertically in the main frame 31 by means of the vertical adjustment screws 59 so that the scoring means 11 is as low as possible in the frame 31 for th height of the cartons to be run through the apparatus. This is to reduce the time required to raise and lower the elevator 25. FIGS. 7 and 8 show the scoring means at a higher elevation than necessary, and it will be understood that for cartons of the height shown in FIGS. 7 and 8, subframe 57 would generally be lower than as shown.

4. The compression head carriage 75 will have been adjusted longitudinally of the subframe 57 by means of screw 71 so that the forward end wall scoring blade 15*b* is somewhat rearward of the forward end wall presser member 19*b* (see FIGS. 4 and 7).

5. The carriage 155 will have been adjusted longitudinally of the lower stage 115 of the subframe 57 by means of screws 157 to the point where the rear end wall presser member 19*a* is somewhat rearward of the rear end wall scoring blade 15*a* (see FIGS. 3 and 7).

6. The side carriages 117*a* and 117*b* will have been adjusted by means of screws 119 to the point where the side wall presser members 17*a* and 17*b* are spaced laterally outward to some extent from the side wall scoring blades 13*a* and 13*b* (see FIG. 8).

7. Adjustments (5) and (6) will have resulted in positioning the left and right rear corner slitters RS*a* and RS*b* for slitting the left and right rear corners of the carton. Adjustment (6) will have resulted in positioning the left and right forward corner slitters FS*a* and FS*b* for slitting the left and right forward corners of the carton. Adjustment (6) will also have resulted in registration of the pass planes of the left and right slitter disk pairs 213 with the planes of the left and right side walls 5*a* and 5*b* of the carton.

8. The guide rods 197 and air cylinders 199 will have been adjusted vertically relative to the left- and right-side carriages 117*a* and 117*b* to the point where the slitter disks 213 are spaced above the side wall presser members 17*a* and 17*b* (and hence above the scoring blades) a distance D equal to or somewhat less than half the width W of the carton (see FIG. 4).

With the apparatus set up as above described, the carton 1, in its position as determined by stop roller 51 and side guides 55, is centered in respect to the scoring blades 13*a*, 13*b*, 15*a* and 15*b* and the presser members 17*a*, 17*b*, 19*a* and 19*b*. With the carton so centered on the platform 25, the latter is raised by operation of the air cylinders 35 up into the subframe 57. The side walls 5*a* and 5*b* of the carton come up between the side wall scoring blades 13*a* and 13*b* (which are initially in their inclined entry position of FIG. 8) and the side wall presser members 17*a* and 17*b* (which are initially in their retracted position of FIGS. 8 and 9). With side wall scoring blades 13*a*, 13*b* in their inclined entry position, they are slightly larger than the inside dimension of the carton and thus engage the side walls and force corner slits 9 to open. The end walls 7*a* and 7*b* of the carton come up between the end wall scoring blades 15*a* and 15*b* (which are initially in their inclined entry position of FIG. 7) and the end wall presser members 19*a* and 19*b* (which are initially in their retracted position of FIGS. 7 and 9). The scoring blades, in effect, enter the carton from the top, and their inclination facilitates the entry.

As the carton is moving up, and as the top T of the contents of the carton approach the scoring blades 13*a*, 13*b*, 15*a* and 15*b*, air cylinder 93 is actuated to retract its piston rod 97, thereby rocking the scoring blades to their horizontal position flat against the bottom of plate 81 and coplanar with plate 83. This brings the outer edges 24 of the side wall scoring blades 13*a* and 13*b* into engagement with the inside of the side walls 5*a* and 5*b* of the carton (see FIG. 4) and the outer edges 24 of the end wall scoring blades 15*a* and 15*b* into engagement with the inside of the end walls 7*a* and 7*b* of the carton (see FIG. 3), with the blades projecting outwardly beyond the contents C of the carton. Upward movement of the platform 25 and carton 1 continues to bring the top T of the contents of the carton into engagement with the bottom face of the plate 83 and the blades and to compress the contents of the carton to expel air therefrom and reduce the volume of the contents to a minimum by reducing the height of the contents. At this point, upward movement of the platform and the carton is terminated.

Figure 6:
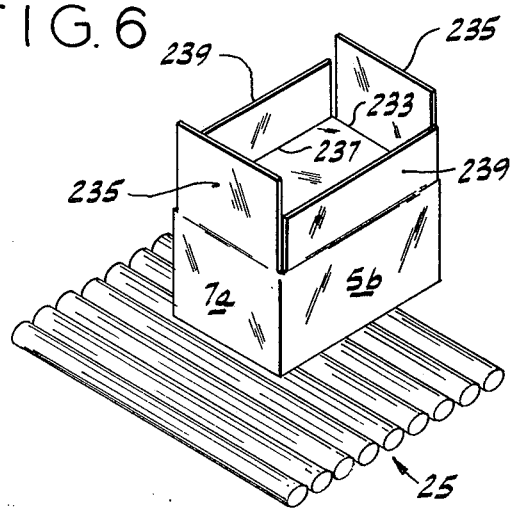
FIG. 6 is a perspective illustrating a carton as completed by the apparatus.

With the platform 25 and carton 1 maintained in raised position, and with the contents C of the carton compressed between the platform and the platen 79, and with the scoring blades 13*a*, 13*b*, 15*a* and 15*b* flat on top of the contents and projecting slightly outwardly beyond the top of the contents around all four sides thereof (FIGS. 3 and 4), the presser members 17*a*, 17*b*, 19*a* and 19*b* are all moved inwardly to press the side walls 5*a* and 5*b* of the carton against the blades 13*a* and 13*b* (FIG. 4) and to press the end walls 7*a* and 7*b* of the carton against the blades 15*a* and 15*b* (FIG. 3) thereby to score the walls on the inside generally at the level of the top T of the contents of the carton. The resultant scores 233 on the inside of the end walls 7*a* and 7*b* define end wall top flaps 235 adapted to be folded down on top of the carton at these scores, and the resultant scores 237 on the inside of the side walls 5*a* and 5*b* define side wall top flaps 239 adapted to be folded down on top of the end flaps at these scores (see FIG. 6). The four scores are generally at the level of the top of the compressed contents of the carton.

Figure 5:
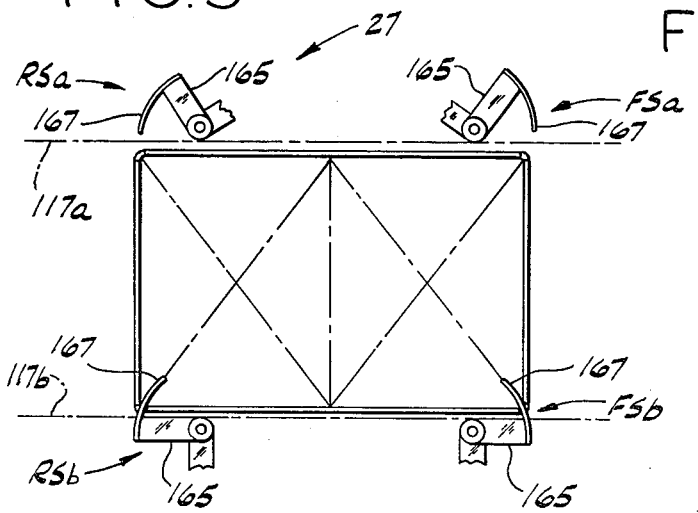
FIG. 5 is a plan generally illustrating a carton corner slitting step.

As the carton 1 moves up, the four carton corner slitting knives 171, in effect, enter the carton from the top at the four corners thereof, and when the carton attains its fully raised position, the knives 171 extend down into the carton generally to the level of the scoring blades (i.e., generally to the level of the top of the contents C of the carton), the curved arms 169 being received in the slots 9 at the carton corners (see FIG. 17). Cylinders 175 and 191 are then actuated to swing the knives out, thereby slitting the four corners of the carton generally down to the level of the score lines 233 and 237, in continuance of the original partial corner slits 9. FIG. 5 shows the two knives for the left-hand corners of the carton swung out, and the two knives for the right-hand corners in their retracted position for purposes of illustration, but it will be understood that, generally, all four knives will initially be in retracted position and will be swung out for slitting all four corners in unison.

Cylinders 199 are actuated to traverse the carriages 211 and the slitter disks 213 along the guide rods 197 from one end of the carton 1 to the other. As the slitter disks 213 are so traversed, they are rotated by engagement of sprockets 229 with the chains 231, and they trim off upper portions 241 (see FIGS. 3 and 4) of the side walls 5*a* and 5*b* to reduce the height of the side wall top flaps 239 to less than half the width W of the carton so that they do not overlap when folded down. Suitable means may be provided for blowing away the trimmed-off portions. Then the elevator 25 is lowered (FIG. 6) and the carton with the completed flap formation is fed forward out of the apparatus by driving the rollers 33, roller 51 being lowered for this purpose.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for forming flaps at the top of an open-top carton after it has been packed, comprising means for internally scoring the walls of the carton generally at the level of the top of the contents of the carton, said scoring means comprising a set of scoring blades, one for each wall of the carton, means mounting said blades to fit in the carton with each blade extending generally horizontally along the inside of a respective wall of the carton and with the blades lying flat on top of the contents of the carton and in a plane generally at the level of the top of the contents, each blade having an outer edge constituting a scoring edge, and a set of presser members, one for each blade, surrounding the blades, means for effecting relative movement of the presser members and blades for scoring the walls of a carton disposed between the blades and the presser members by compressing the walls between said scoring edges of the blades and the presser members, and means for effecting relative movement of the carton and said scoring means to position the blades inside the carton on top of the contents of the carton with the blades lying flat on top of the contents in said plane and with the walls of the carton between the blades and the presser members, the latter and the blades then being relatively movable for compression of the walls between said scoring edges of the blades and the presser members to score the walls on the inside thereof generally at said level.

2. Apparatus as set forth in claim 1 further having means for slitting the corners of the carton generally down to said level.

3. Apparatus as set forth in claim 2 further having means for trimming off the top of two opposite walls of the carton in accordance with said level so that the flaps at the top of said two opposite walls may be folded on top of the carton without overlap.

4. Apparatus as set forth in claim 1 wherein the scoring means is adjustable for operation on cartons of different size.

5. Apparatus as set forth in claim 4 having means for slitting the corners of the carton generally down to said level, said slitting means being adjustable along with said scoring means for operation on cartons of different size.

6. Apparatus as set forth in claim 5 further having means for trimming off the tops of two opposite walls of the carton in accordance with said level so that the flaps at the top of said two opposite walls may be folded on top of the carton without overlap, said trimming means being adjustable along with said scoring means for operation on cartons of different size.

7. Apparatus as set forth in claim 1 wherein each presser member is mounted for movement from a retracted position spaced outwardly from its respective blade in inward direction toward said blade for scoring the wall disposed between said blade and said presser member.

8. Apparatus as set forth in claim 1 having a compression head carrying said scoring blades, the contents of the carton engaging the bottom of said head and said blades upon said relative movement of the carton and said scoring means to compress the contents.

9. Apparatus as set forth in claim 7 wherein the scoring means is operative at a predetermined elevation, and said means for effecting said relative movement of the carton and the scoring means comprises an elevator for raising the carton up to the scoring means and lowering the carton, after forming the flaps, down from the scoring means, the carton being raised to a position determined by engagement of the top of its contents with said blades.

10. Apparatus as set forth in claim 7 wherein the scoring means is adjustable for operation on cartons of different size.

11. Apparatus as set forth in claim 10 wherein the set of scoring blades is replaceable with a set of scoring blades of different size and wherein certain of the presser members are adjustable in and out relative to the blades.

12. Apparatus as set forth in claim 11 wherein certain of the presser members are replaceable with presser members of different length.

13. Apparatus as set forth in claim 9 having means operative in vertically fixed relation to the elevator for slitting the corners of the raised carton generally down to the level of the top of the contents of the carton.

14. Apparatus as set forth in claim 13 further having means operative in vertically fixed relation to the elevator for trimming off the tops of the two opposite walls of the carton in accordance with said level so that the flaps at the top of said two opposite walls may be folded on top of the carton without overlap.

15. Apparatus for forming flaps at the top of an open-top carton after it has been packed, comprising means for internally scoring the walls of the carton generally at the level of the top of the contents of the carton, said scoring means comprising a set of scoring blades, one for each wall of the carton, said blades being arranged to fit in the carton with each blade extending generally horizontally along the inside of a respective wall of the carton, and a set of presser members, one for each blade, surrounding the blades, means for effecting relative movement of the presser members and blades for scoring the walls of a carton disposed between the blades and the presser members by compressing the walls between the blade edges and the presser members, and means for effecting relative movement of the carton and said scoring means to position the blades inside the carton on top of the contents of the carton with the blades projecting outwardly beyond the contents and with the walls of the carton between the blades and the presser members, the latter and the blades then being relatively movable for compression of the walls between the blade edges and the presser members to score the walls on the inside thereof generally at said level, each presser member being mounted for movement from a retracted position spaced outwardly from its respective blade in inward direction toward said blade for scoring the wall disposed between said blade and said presser member, each blade being mounted for rocking movement between a position for entry in the carton inclined upwardly and outwardly and a generally horizontal scoring position on top of the contents of the carton.

16. Apparatus as set forth in claim 15 having means for rocking the blades between their entry position and their scoring position.

17. Apparatus for forming flaps at the top of an open-top carton after it has been packed comprising a frame, a carton elevator movable up and down in the frame, a compression head extending down from the top of the frame above the elevator, a set of scoring blades, one for each wall of the carton, mounted at the bottom of said head, said blades being arranged to fit in the carton with each blade extending generally horizontally along the inside of a respective wall of the carton, a set of presser members, one for each blade, carried by the frame surrounding the blades, means mounting each of said presser members on the frame for movement from a retracted position spaced outwardly from its respective blade in inward direction toward said blade for effecting scoring of the wall of a carton disposed between the blade and the presser member by pressing the wall against the blade edge, said elevator being adapted to raise a carton to compress the contents of the carton against the bottom of the head and the blades with the walls of the carton disposed between the blades and the presser members, the blades projecting outwardly beyond the contents, the presser members then being movable inwardly to press the walls against the blade edges, the compression head having a platen at its lower end, and the blades being pivotally mounted at the edges of the platen for rocking movement between a position for entry in the carton inclined upwardly and outwardly and a horizontal scoring position on the bottom of the platen.

18. Apparatus as set forth in claim 17 having means carried by the head for rocking the blades between their entry position and their scoring position.

19. Apparatus for forming flaps at the top of an open-top carton after it has been packed comprising a frame, a carton elevator movable up and down in the frame, a compression head extending down from the top of the frame above the elevator, a set of scoring blades, one for each wall of the carton, mounted at the bottom of said head, each blade having an outer edge constituting a scoring edge, said blades being arranged to fit in the carton with each blade extending generally horizontally along the inside of a respective wall of the carton and with the blades lying flat on top of the contents of the carton in a plane generally at the level of the top of the contents and projecting laterally outwardly beyond the top of the contents so that their scoring edges are laterally outward of the top of the contents, a set of presser members, one for each blade, carried by the frame surrounding the blades, means mounting each of said presser members on the frame for movement from a retracted position spaced outwardly from its respective blade in inward direction toward said blade for effecting scoring of the wall of a carton disposed between the blade and the presser member by pressing the wall against the scoring edge of the blade, said elevator being adapted to raise a carton to compress the contents of the carton against the bottom of the head and the blades with the walls of the carton disposed between the blades and the presser members, the blades lying flat on top of the contents in said plane with their scoring edges laterally outward of the top of the contents, the presser members then being movably inwardly to press the walls against said scoring edges of the blades.

20. Apparatus as set forth in claim 19 having a pair of blades and a pair of presser members for scoring the side walls of a rectangular carton and a pair of blades and a pair of presser members for scoring the end walls of the carton, means mounting at least one of the side wall presser members for adjustment transversely of the apparatus, and means mounting at least one of the end wall presser members for adjustment longitudinally of the apparatus.

21. Apparatus as set forth in claim 20 having means mounting both side wall presser members for adjustment transversely of the apparatus comprising a pair of carriages carried by the frame for adjustment in and out transversely of the frame.

22. Apparatus as set forth in claim 21 further comprising means for slitting the four corners of the carton generally down to said level, said slitting means being carried by said carriages.

23. Apparatus as set forth in claim 22 further comprising means for trimming off the top of the side walls of the carton in accordance with said level so that the side flaps of the carton may be folded on top of the carton without overlap, said trimming means being carried by said carriages.

* * * * *